US006273150B1

(12) United States Patent
Shaw et al.

(10) Patent No.: US 6,273,150 B1
(45) Date of Patent: Aug. 14, 2001

(54) METHOD AND APPARATUS TO MONITOR FILLING INSERTION IN A WEAVING MACHINE, WITH DETECTION OF AN EXACT TIME AT WHICH THE FILLING IS ACTUALLY SEVERED

(75) Inventors: Henry Shaw, Steenvoorde (FR); Herman Salomez, Zonnebeke (BE)

(73) Assignee: Picanol N.V., Ieper (BE)

( * ) Notice: Subject to any disclaimer, the term of this patent is extended or adjusted under 35 U.S.C. 154(b) by 0 days.

(21) Appl. No.: 09/555,524

(22) PCT Filed: Dec. 7, 1998

(86) PCT No.: PCT/EP98/07942

§ 371 Date: Aug. 22, 2000

§ 102(e) Date: Aug. 22, 2000

(87) PCT Pub. No.: WO99/29946

PCT Pub. Date: Jun. 17, 1999

(30) Foreign Application Priority Data

Dec. 11, 1997 (BE) ..... 9701007

(51) Int. Cl.[7] ..... D03D 47/36

(52) U.S. Cl. ..... 139/435.1

(58) Field of Search ..... 139/435.1, 434

(56) References Cited

U.S. PATENT DOCUMENTS 4,834,145 * 5/1989 Lewyllie ..... 139/194
4,917,153 * 4/1990 Mori et al. ..... 139/435.1
5,105,856 * 4/1992 Wahhoud ..... 139/194

* cited by examiner

*Primary Examiner*—Andy Falik
(74) *Attorney, Agent, or Firm*—Bacon & Thomas, PLL

(57) ABSTRACT

A method and apparatus to monitor filling insertion in a weaving machine. A filling (3, 4) is severed during insertion by a filling-scissors (15), and the actual time at which the filling (3, 4) is severed is detected.

11 Claims, 7 Drawing Sheets

METHOD AND APPARATUS TO MONITOR FILLING INSERTION IN A WEAVING MACHINE, WITH DETECTION OF AN EXACT TIME AT WHICH THE FILLING IS ACTUALLY SEVERED

FIELD OF THE INVENTION

The invention relates to a method and apparatus to monitor filling-yarn insertion in a weaving machine, the particular filling to be inserted being severed from a previously inserted filling already bound into a fabric.

RELATED ART

Illustratively as regards gripper weaving machines, a feed gripper picks up a filling which shall be inserted into a shed, the front part of the filling being still connected to the previously inserted and now woven filling while its portion to be inserted is kept in readiness by a yarn feeder or the like. The filling to be inserted must be severed by filling-scissors at the beginning of insertion. There is an attendant risk that the filling might not be properly picked up by the feed gripper or that it will be torn between the fabric and the feed gripper.

SUMMARY OF THE INVENTION

The objective of the invention is to create a method to substantially avoid the danger of improperly picking up the filling to be inserted and/or the tearing of the filling at the fabric.

This problem is solved by detecting the time at which the filling is severed.

In one embodiment of the invention this problem is solved by a device for detecting the time of severing the filling.

By detecting the time at which the filling is actually severed, it is possible to adjust the operation of the filling-scissors and/or to so match other elements with the filling insertion that untimely cutting of the filling is avoided. Premature filling-severing in most instances entails improper pickup of the filling by the feed gripper. Delayed severing in most cases results in tearing of the filling between the fabric and the feed gripper.

The invention is based on the recognition that the instant at which a filling is actually severed does not coincide with the instant at which the scissor blades of a filling-scissors assume a given position. Instead, a filling is actually severed as a function of its thickness or its position relative to said scissor blades or of the motion of said blades at their different positions.

In a preferred embodiment of the invention, the filling tension is detected for the purpose of determining the time of severing of the filling. This procedure takes advantage of the fact that upon filling severing, the tension of the filling drops abruptly and consequently the time of cutting can be determined very accurately in this manner.

BRIEF DESCRIPTION OF THE DRAWINGS

Further features and advantages of the invention are shown in the description below of illustrative embodiments shown in the drawings and described in the claims that follow.

DETAILED DESCRIPTION OF THE PREFERRED EMBODIMENTS

Figure 1:
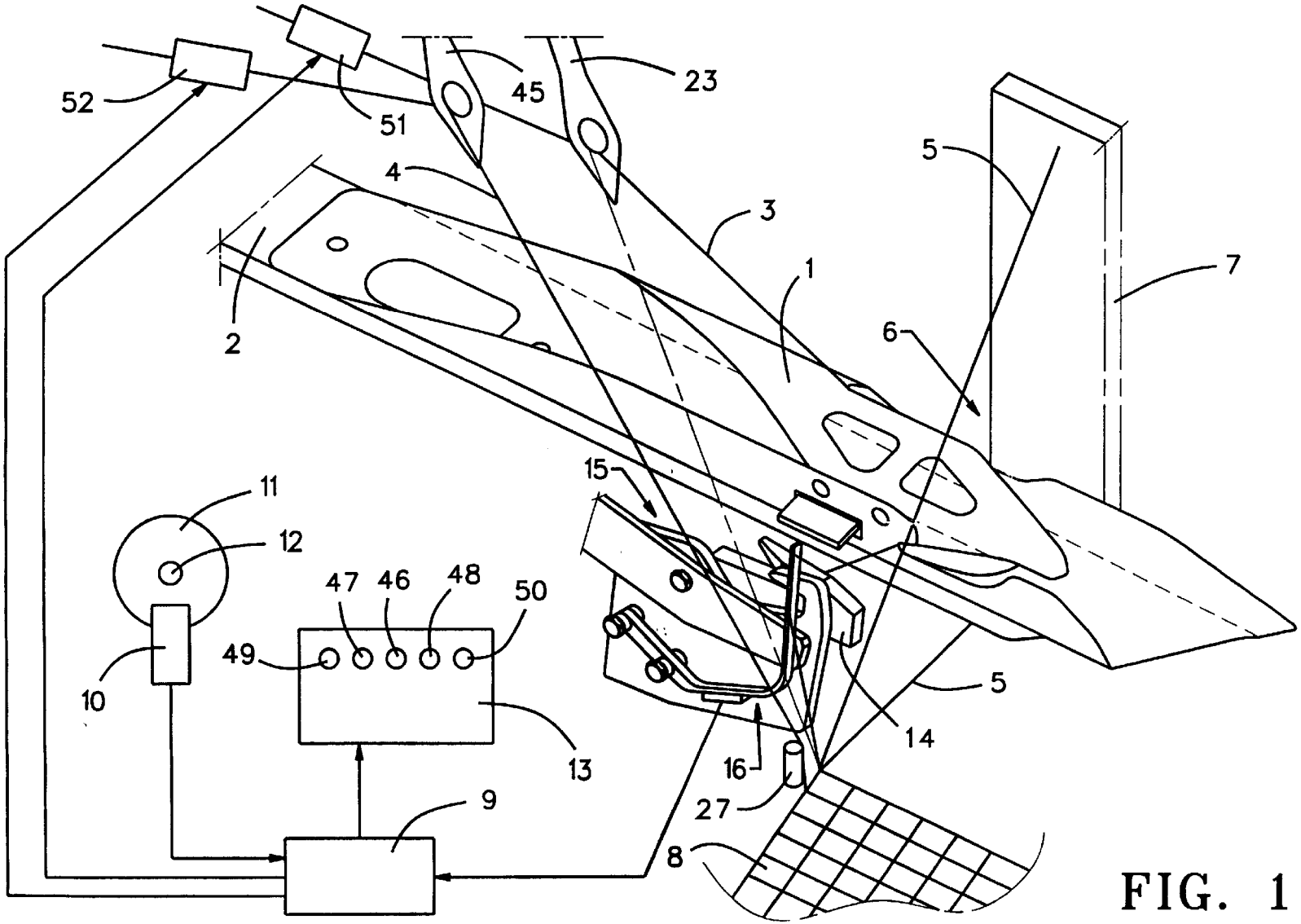
FIG. 1 schematically shows a detail of a gripper weaving machine with the apparatus of the invention.

The gripper weaving machine shown in the form of a detail in FIG. 1 comprises a feed gripper 1 driven by a gripper band 2 for the purpose of inserting a filling 3 or 4 into a shed 6 formed of warps 5. The feed gripper 1 moves a filling 3 or 4 from the insertion side as far as approximately the middle of the shed 6. There, a receiving gripper (not shown) picks up the filling 3 or 4 and moves it to the opposite side of the shed 6. The warps 5 are moved up and down by a schematically shown harnesses 7 in order to form sheds 6. An inserted filling 3, 4 is beaten against the fell line of the schematic fabric 8.

The gripper weaving machine furthermore includes a control unit 9 receiving signals from a measuring element 10 cooperating with an encoding disk 11. The encoding disk 11 is mounted on a shaft 12 running synchronously with the main drive shaft for the drive device of the gripper band 2. A display 13 is connected to the control system 9 and will be described further below. The gripper weaving machine further includes a filling clamp 14, a filling-scissors 15 and a detecting device to detect that time at which a filling 3 or 4 in fact is being severed. Said detecting device includes a measuring unit 16 connected to the control unit 9.

Figure 2:
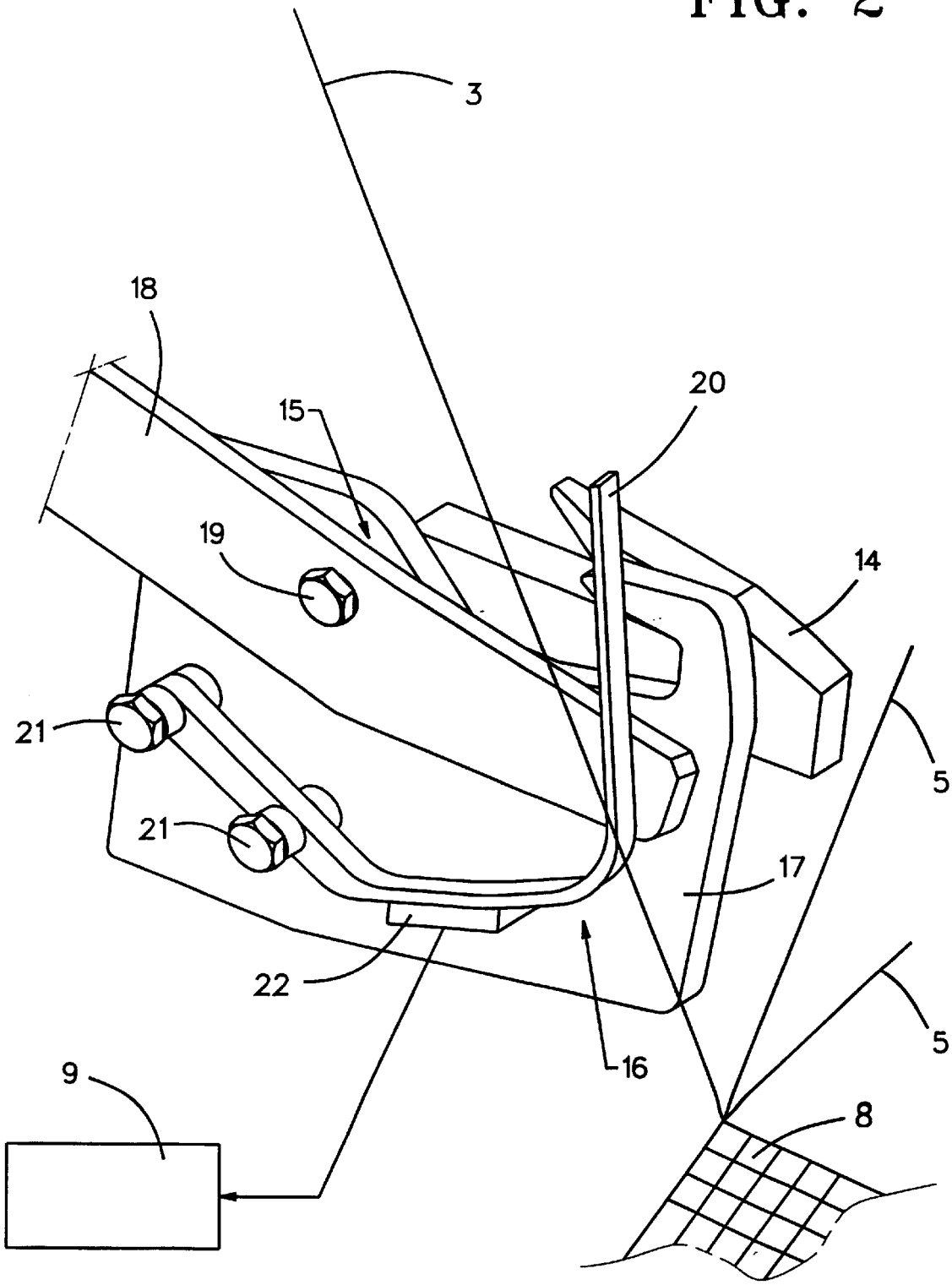
FIG. 2 is a detail of the apparatus of FIG. 1 on a larger scale.
Figure 3:
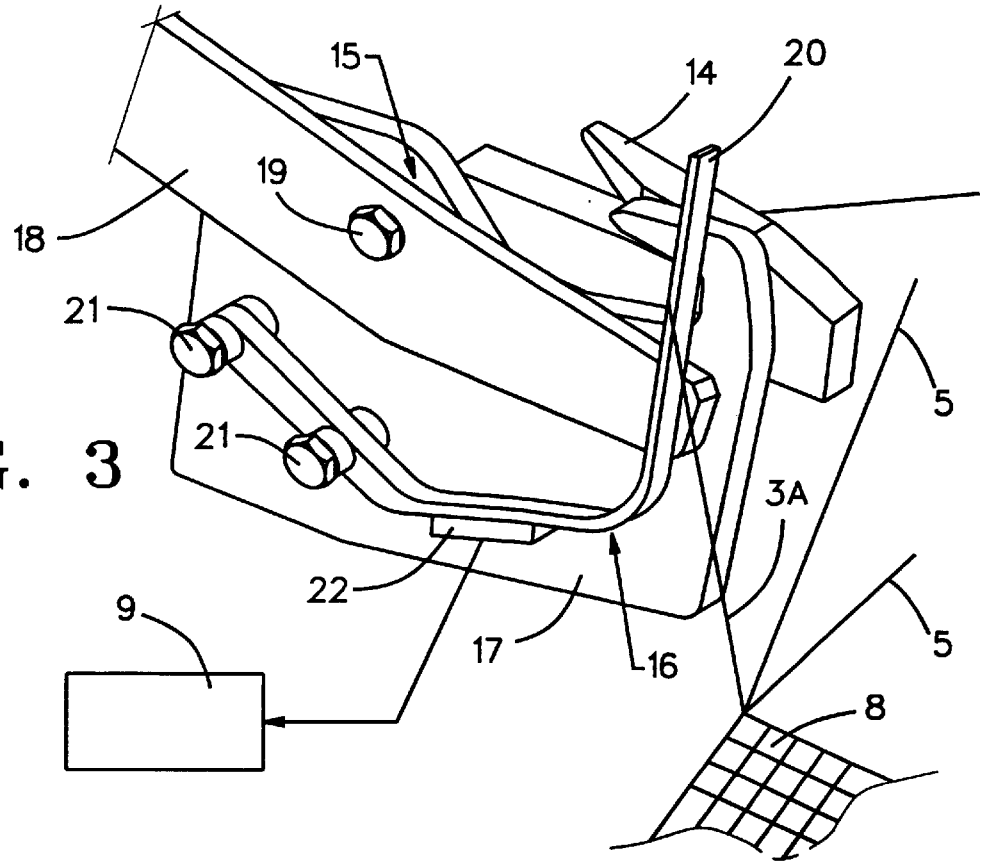
FIGS. 3, 4 show the detail of FIG. 2 immediately before and after severing a filling.
Figure 4:
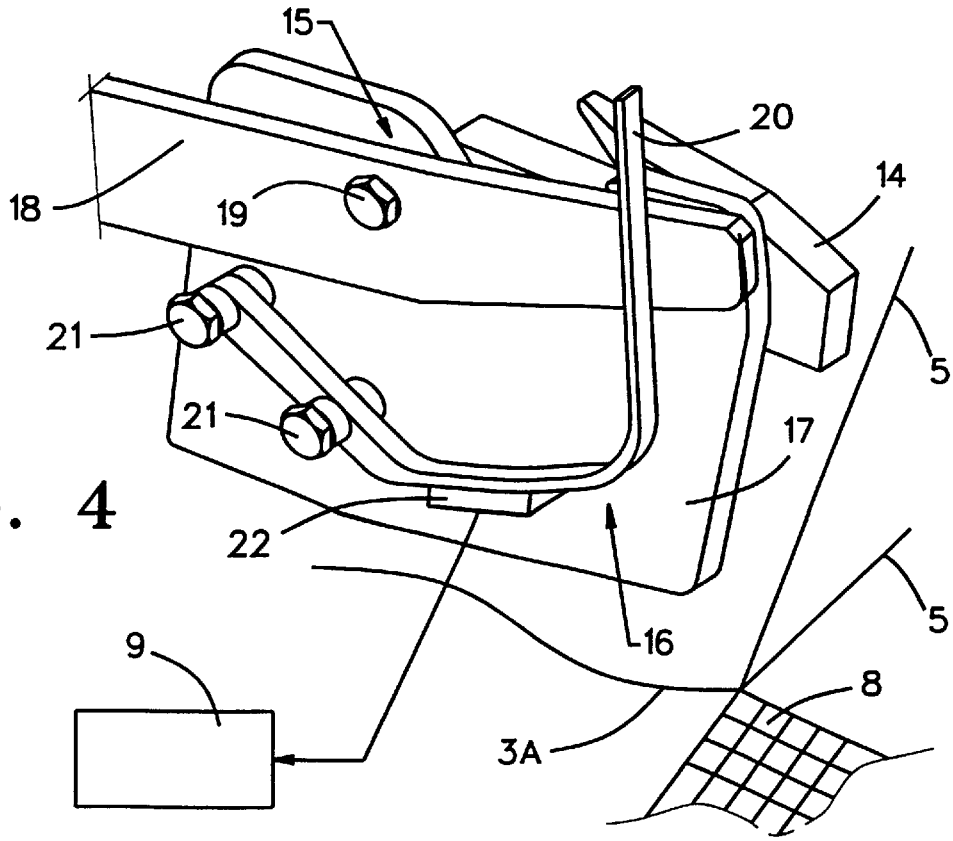

The filling-scissors 15 is shown especially clearly in FIGS. 2 through 4 and comprises a fixed blade 17 mounted on a frame (not shown) of a weaving machine. The filling-scissors 15 further comprises a movable, shearing blade 18 which is driven in a manner not shown in further detail. The two blades 17, 18 are joined together by a pin 19.

The measuring unit 16 includes a resilient bow 20 affixed at one end by screws 21 to the fixed scissors blade 17. One or more sensors 22, i.e. strain gauges, are mounted on the resilient bow 20 and are connected to the control unit 9, as a result of which deformation of the bow 20 will be detected by the control unit 9.

FIG. 2 shows the filling 3 in a position at which it is kept ready for a feed gripper. The blades 17 and 18 of the filling-scissors 15 are open. The position of the filling 3 corresponds to that shown in dashed lines in FIG. 1 between the eye of a controlled yarn feeding holder 23 and a yarn guide 27 which is mounted laterally in the vicinity of the fabric 8.

The filling 3 is seized by the feed gripper 1 and moved with it, as a result of which the filling 3 is inserted into a filling clamp 14 and into the filling-scissors 15 as shown in solid lines in FIG. 1. The elastic bow 20 of the measuring element 16 is configured in such a way that the as yet un-severed filling 3—in particular the filling segment 3A at the side of the fabric 8 next to the filling-scissors 15—makes contact with the bow 20. The bow 20 is mounted in such manner that it is deformed by the as yet un-severed filling 3 while this filling 3 is being moved into the filling-scissors 15.

FIG. 3 shows the filling 3 in a position shortly before it will be severed. The resilient bow 20 is deformed a relatively large amount, and such deformation depends on the yarn tension in the filling segment 3A which is substantially located within the area of the filling-scissors 15.

FIG. 4 shows a position immediately following severing the filling 3. The severed filling 3 and in particular the filling segment 3A no longer load the bow 20. The other part of the filling 3, no longer visible in FIG. 4, is carried away by the feed gripper 1 and moved into the shed. The bow 20 is configured in such manner that it shall be load-relieved immediately after the filling 3 has been severed. Thereupon the bow 20 assumes again the position shown in FIG. 2. The movable scissors blade 18 also returns into its position shown in FIG. 2. As shown by FIGS. 2 through 4, the bow 20 together with the filling 3 is deformed, prior to severing the filling 3, by the tension in the filling segment 3A. At the very moment the filling 3 is severed, the yarn tension in the filling segment 3A is eliminated and the bow 20 is relieved of stress. Accordingly the time at which the filling 3 is severed is determined by that instant at which the yarn tension in the filling segment 3A directly at the filling-scissors 15 disappears.

Advantageously the resilient bow 20 of the measuring element 16 is mounted in the immediate vicinity of the filling-scissors 15, as a result of which the filling 3 shall cease pressing against the bow 20 immediately after severing has taken place. In such a case and following severing, no other component is able to keep the filling segment 3A against the bow 20. The tension in the bow 20 of the measuring unit 16 therefore drops abruptly as soon as the filling 3 has been severed. In this manner the time of severing can be accurately detected. Because usually little space is available between the filling-scissors 15 and the filling clamp 14, the configuration of the elastic bow 20 of the measuring unit 16 between the filling-scissors 15 and the fabric 8 will be advantageous. However, in the absence of a filling clamp 14, the resilient bow 20 of the measuring unit 16 may be mounted on each side of the filling-scissors 15.

The measuring unit 16 associated with the resilient bow 20 is advantageous not only in detecting the time of severing the filling 3, but it also acts as a compensating device. Because of such compensation, the time of severing is somewhat less critical in gripper weaving machines because of the lesser likelihood of tearing the filling 3 between the fabric 8 and the feed gripper 1 on account of delayed filling-severing.

Figure 5:
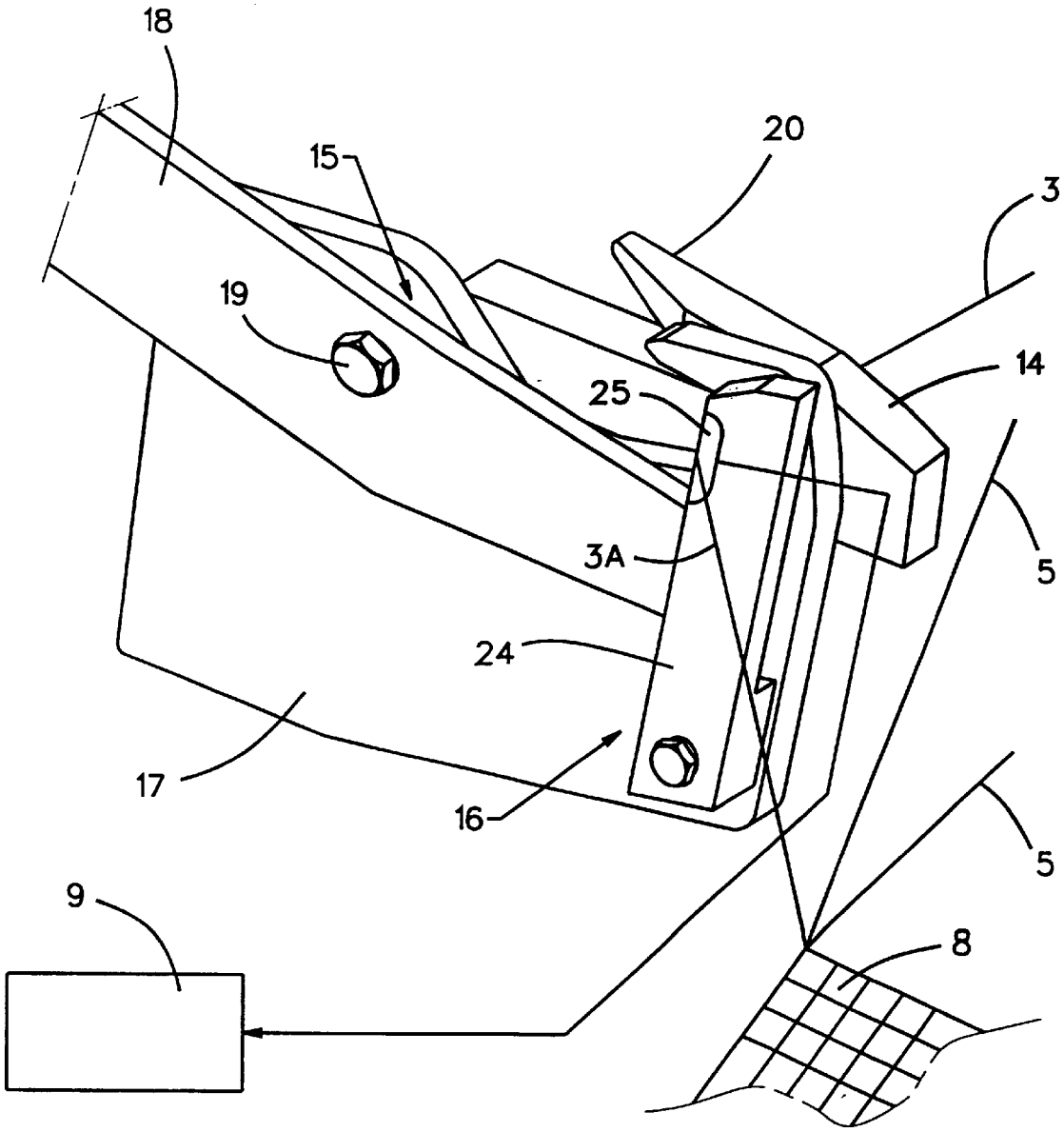
FIG. 5 is a view similar to FIG. 2 of a modified apparatus.

In the embodiment shown in FIG. 5, the time detecting device for detecting the time of severing the fillings 3 or 4 includes a measuring unit 16 fitted with a support 24 mounted on the fixed scissors blade 17. The support 24 is fitted with a pressure sensor 25, for instance a piezoelectric pickup mounted in such a way that the as yet un-severed filling 3, 4 rests against it while still tensioned or compressed. The pressure pickup or sensor 25 is connected to the control unit 9 and thereby allows detecting and severing the filling by the tension in the filling segment 3A. Before the filling 3 or 4 is severed, the filling segment 3A acts on the pressure sensor 25 over a substantial time interval and the pressure sensor as a result determines the presence of a yarn tension. When the filling yarn 3 or 4 is severed, the yarn tension vanishes and consequently the sensor 25 is no longer loaded. In this manner the time at which the filling 3 or 4 was in fact severed shall be determined as that time at which the yarn tension in the filling segment 3A vanishes.

Figure 6:
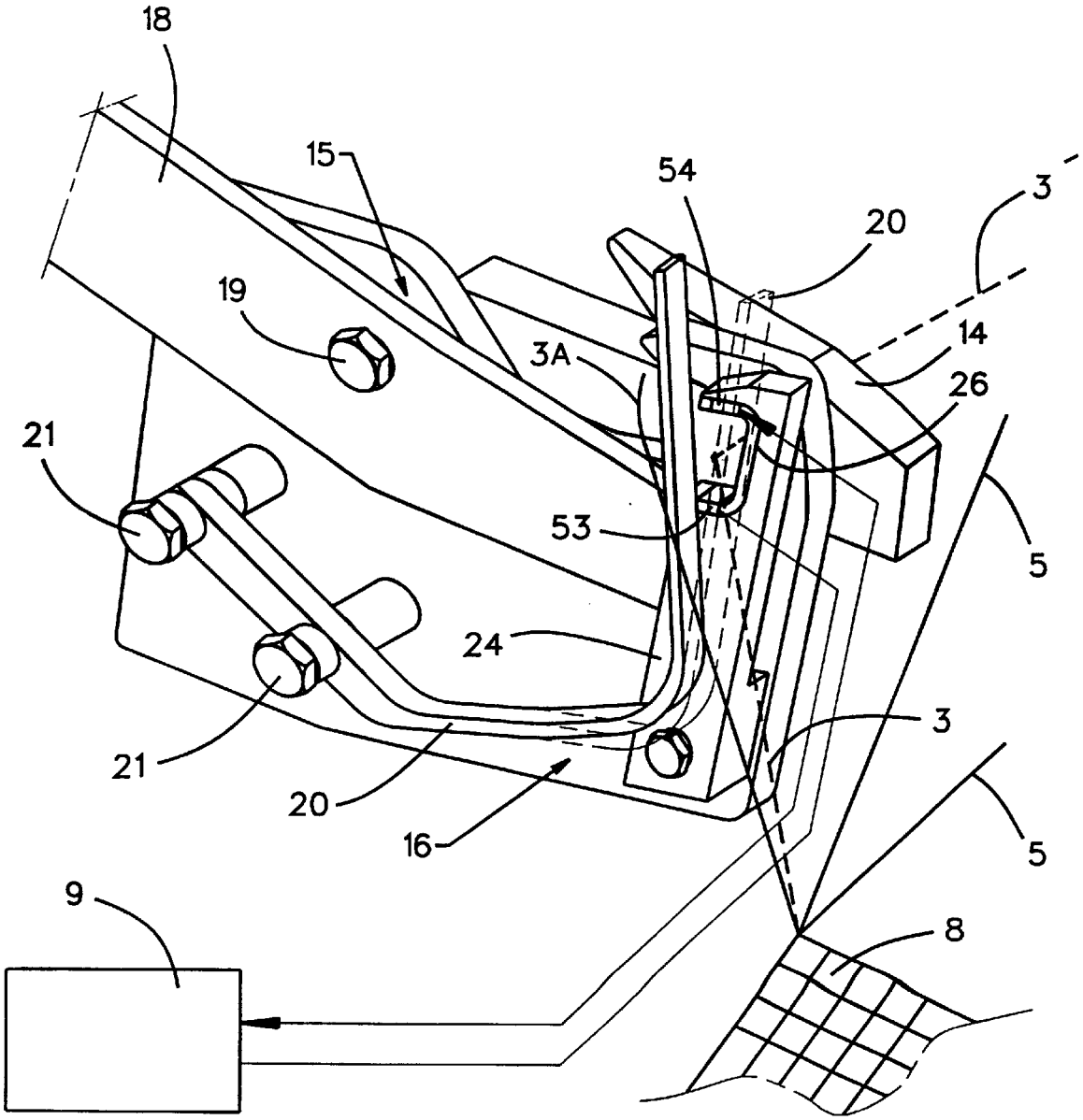
FIG. 6 is a view similar to FIG. 2 showing an optical detector to detect the time a filling is severed.

In the embodiment of FIG. 6 the time detecting device for detecting the time of severing the fillings 3 or 4 includes a measuring unit 16 fitted with an elastic bow corresponding to that of FIGS. 1 through 4 and an optical sensor 26. The optical sensor 26 is held in place by a support 24 mounted on the fixed scissors blade 17 and comprises a photodetector 53 and a photo emitter 54. Before the filling 3 or 4 is cut and definitively severed, the filling segment 3A will deform the resilient bow 20 whereby the bow and the fillings 3, 4 are in a position shown by dashed lines in FIG. 6. In this state the filling segment 3A interrupts the light beam between emitter 54 and detector 53, and as a result, over a sufficiently long time interval, the optical sensor 26 determines the presence of a filling 3 or 4. As soon as the filling 3 or 4 is severed, the filling segment 3A and the resilient bow 20 assume positions shown by a solid line in FIG. 6. The filling segment 3A was removed by the resilient bow 20 from the zone of the optical sensor 26 which thereby no longer detects fillings. Accordingly the time at which the filling 3, 4 is severed can be ascertained as that time at which the optical sensor 26 no longer detects the filling segment 3A.

The control unit 9 is fitted with a display device for displaying the time at which a filling was severed and which can be represented in a number ways on a display 13. For instance, the severing time may be represented as a time value, or an angular value of the shaft 12 described above or as a value of the longitudinal position of the feed gripper 1 in its direction of motion. The value of longitudinal position of the feed gripper 1 can be determined in a simple manner from the angular position of the shaft 12, and vice-versa.

However, in a preferred embodiment of the invention, the time of severing is not represented as the actual value on the display 13. Instead and as shown in FIG. 1, this value is indicated by luminescent elements 46 through 50. The center element 46 lights up when there is coincidence between the time of actually severing the filling 3 or 4 with the desired time of severing. If the severing occurs somewhat prematurely, the element 47 will light up. The element 48 lights up when the severing takes place somewhat too late. The element 49 lights up if the severing is substantially too premature and the element 50 if it is substantially too late. In such a case the operator may adjust an input unit, for instance the input unit 43 of FIG. 7 in order to so change the operation of the filling-scissors 15 that the actual severing takes place earlier or later. The operator is able to monitor proper adjustment by checking which of the luminescent elements 46 through 50 will light up after such an adjustment.

Figure 7:
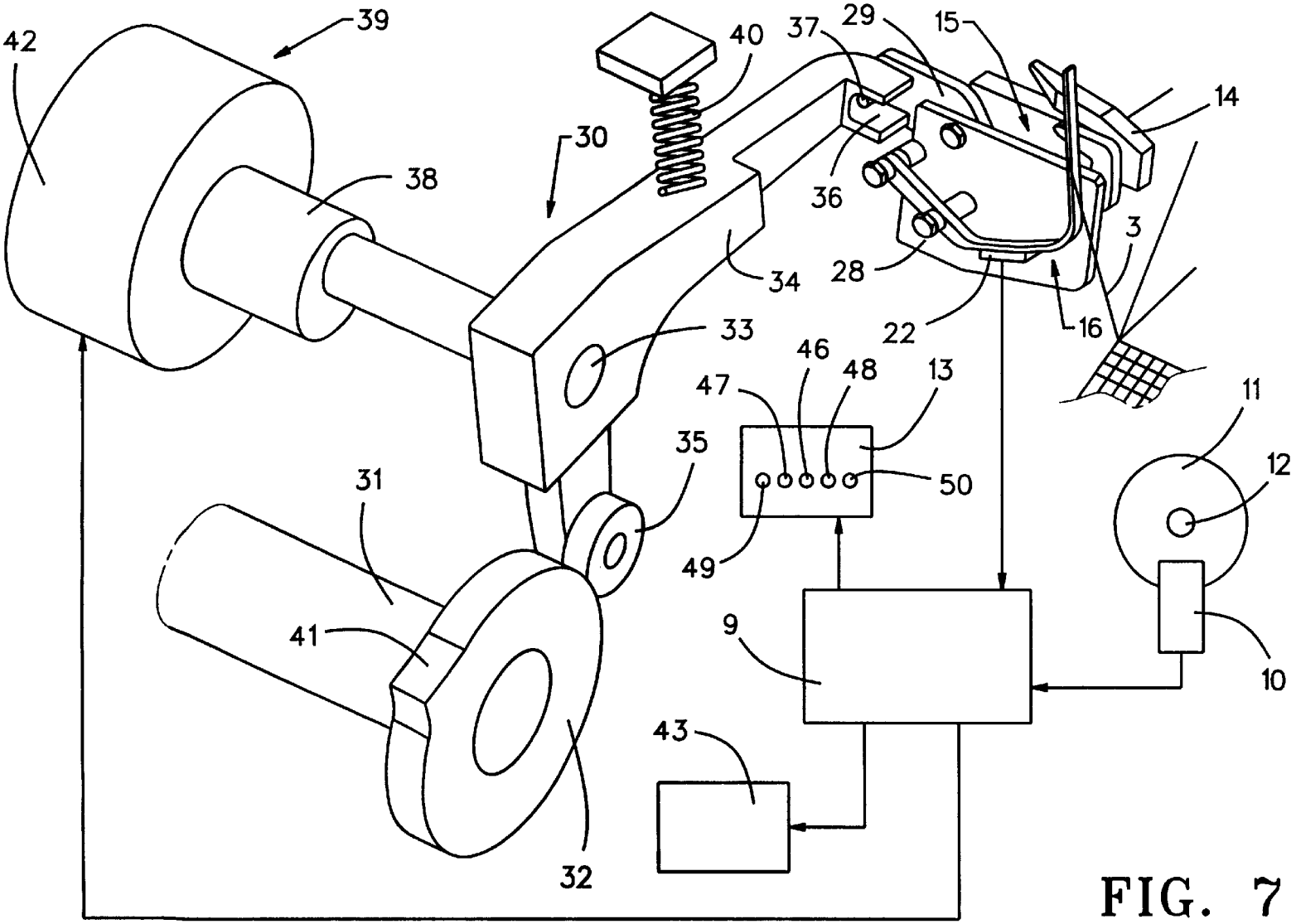
FIG. 7 is a detail of a gripper loom showing the invention and a drive for the filling-scissors.

FIG. 7 shows an illustrative embodiment of a drive device for a filling-scissors 15. This filling-scissors 15 comprises a stationary shear blade 28 affixed to a weaving machine frame (not shown) and a relatively displaceable shear blade 29 which is pivoted by a drive device 30. The drive device 30 comprises a drive shaft 31 running synchronously with the above-described shaft 12. A cam disk 32 is mounted in angularly adjustable manner on the drive shaft 31. The drive device 30 furthermore comprises a lever 34 which is pivotable about a shaft 33. At one of its ends this lever 34 is fitted with a cam follower 35 cooperating with the cam disk 32. At its other end the lever 34 comprises a fork 36 cooperating with a pin 37 affixed to the pivotable scissors blade 29. The pivot 33 is configured eccentrically in a shaft 38 supported in a manner not shown in further detail in the frame of the loom. Moreover, an adjusting device 39 is provided to rotate the shaft 38 and thereby to change the position of the pivot 33. Also a loading spring 40 is used to bias the lever 34 and to press the cam follower 35 against the cam disk 32.

In the embodiment of FIG. 7, the adjusting device 39 comprises an adjusting motor 42—in particular a stepping motor—driven by the control unit 9. Control is carried out as a function of given values fed by an operator at the input unit 43 into the control unit 9. In this manner the adjusting device 39 can be situated in places which are difficult to access by the operator.

A filling located in the filling-scissors 15 will be severed and the time of severing will be detected by the measuring element 16 of the embodiment of FIGS. 1 through 4. The filling 3 will be severed when the cam 41 of the cam disk 32 cooperates with the cam follower 35. The time of severing is displayed in the display 13. If the displayed time is earlier or later than the desired severing time, that is, for instance if one of the luminescent elements 47 through 50 lights up, then the operator, by feeding certain values to the input unit 43, changes the angular position of the adjusting motor 42 driven by the control unit 9 and hence the position of the shaft 33. This procedure continues until the fillings are severed at the desired time, that is when the luminescent element 46 shall light up. During this adjustment the operator changes the adjusted values in such manner that the difference between the detected and the desired times of severing the filling 3 or 4 shall be zero. The path followed by the displaceable scissors blade 29 is modified by changing the position of the shaft 33. The position of the cam disk 32 relative to the drive shaft 31 may be changed if, when using the above adjustment procedure, it is impossible to null the difference between detected and desired times of severing.

Following an adjustment, the shaft 38 shall be non-rotatable. This feature can be implemented, for example, by the adjusting motor 42 being a stepping motor continuously supplied with a latching current. Obviously the shaft 38 also may be mechanically stopped following such adjustment.

Figure 8:
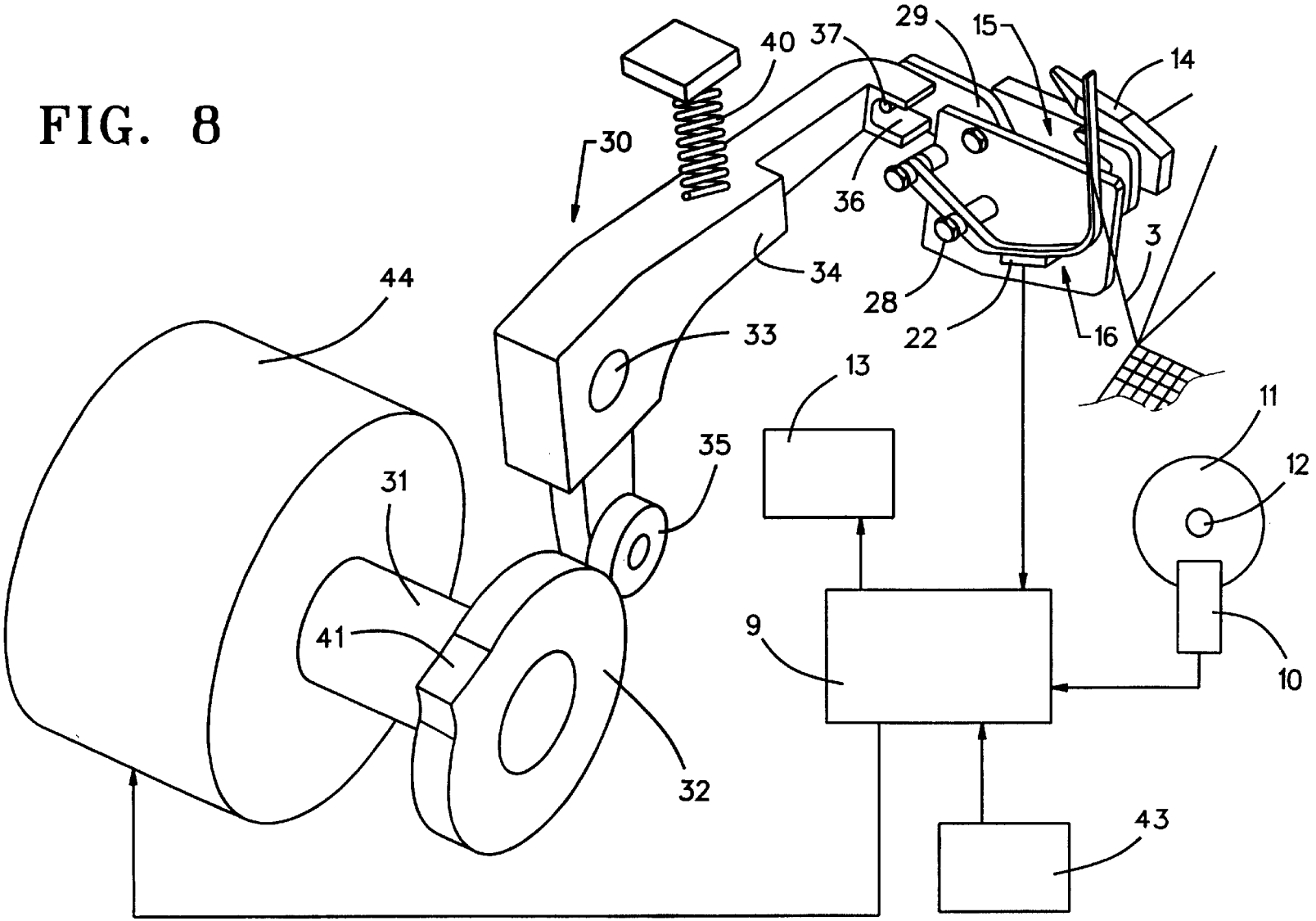
FIG. 8 is another embodiment of the invention with a filling-scissors drive.

In the embodiment of FIG. 8 the shaft 33 of the lever 34 is stationary. The drive shaft 31 is driven by a drive motor 44. This motor can control the path of the scissors blade on the basis of the data from the control unit 9 independently of the angular position of the gripper weaving machine, that is regardless of the angular position of the shaft 12. The path of the scissors blade 29 obviously depends on the weaving cycle and is nearly synchronous with the rotation of the shaft 12, as a result of which the filling-scissors 15 severs the filling at each weaving cycle. However the desired time of filling-severing by means of the filling-scissors 15 can be input by an operator through the input unit 43 into the control unit 9. Thereupon the actual time of severing is determined as described above. If the time of severing were to be after the adjusted time, then, where called for, the control unit 9 may automatically drive the drive motor 44 in such manner that the filling-scissors shall sever the filling at an earlier time within the weaving cycle. If the time of severing is earlier, then, if desired, the control unit 9 may automatically so modify the control that the filling-scissors 15 severs the filling somewhat later within the weaving cycle.

The drive motor 42 of FIG. 7 also can be adjusted in both directions of rotation by the control unit 9 so that the actual time of a filling being severed coincides with the time set at the input unit 43.

When two or more and in particular also different fillings 3 or 4 are woven by the same gripper weaving machine, then for each of the fillings 3 or 4, the severing time may be determined in the manner described above. The severing time of one filling 3 or 4 may differ from the other because this severing depends on the thickness of the fillings 3 and 4 and also on their spatial position relative to the filling-scissors 15 as determined by the position of the associated yarn feeds 23 or 45 and the position of the yarn guide 27 (FIG. 1). However, in most cases the severing times will differ only slightly.

In the embodiment of FIG. 7 that includes the controllable adjusting motor 42 and in the embodiment of FIG. 8, the severing time can be appropriately selected for each filling 3 or 4 and fed by the input unit 43 into the control unit 9. In the embodiment of FIG. 7 the setting motor 42 is commensurately rotated to-and-fro. In the embodiment of FIG. 8 the path of the drive motor 44 can be selected in such a way that the filling-scissors 15 actually shall sever each of the fillings 3 or 4 at the selected time. This embodiment offers the advantage that each filling can be severed at its own predetermined time.

Furthermore the invention provides for combinations of the embodiments of FIGS. 1 through 8. For example, the shaft 33 may be adjusted by the adjusting device 39 including an adjusting motor 42, the drive shaft 31 being powered by a drive motor 44.

In an embodiment not shown in the drawings, the adjusting device 39 shown in FIG. 7 includes a worm engaging a worm gear which can be rotated jointly with the shaft 38. Accordingly, when weaving with two or more different fillings 3 or 4, a tradeoff may be sought in order that the filling-scissors 15 shall sever almost all fillings at the same defined time.

Detection of the severing time of a filling 3 or 4 also is advantageous in applications other than adjusting the filling-scissors 15. In regard to gripper looms including a yarn brake 51 or 52 electrically controlled by the control unit 9 and situated between a filling feed system (Not shown in FIG. 1) and the associated yarn feeds 23 or 45, the braking by these yarn brakes 51, 52 can be controlled by a signal from the control unit 9 as a function of the severing time detected in the above described manner. The braking control of the yarn brakes 51, 52 may be suspended at a given time in order that the filling can be inserted into shed 6 by the feed gripper 1 with only at a slight tension. The yarn brakes 51, 52 shown schematically in FIG. 1 for example may be separately mounted in the manner known from U.S. Pat. No. 5,002,098. Such yarn brakes 51, 52 also may be used with yarn preparing devices, for instance pre-winders as disclosed in U.S. Pat. No. 5,343,899.

In gripper weaving machines, the associated yarn feeding holder 23 or 45 illustratively is controlled in the manner of U.S. Pat. No. 5,400,834 by a drive motor controlled by the control unit 9. After the severing time has been detected, the yarn feed 23, 45 may be slightly moved upward in order to minimize deflecting the filling to be inserted during this insertion, as a result of which the filling can be inserted into shed 6 farther with little tension by the feed gripper 1. This procedure can be implemented by the particular yarn feed 23 or 45 being moved upward immediately after filling severing.

The detected severing time of a filling also may be used to control other weaving machine elements as a function of the detected time. For example, electrically controlled gripper-openers described in the patent document WO 97/40218 or other electrically controlled devices can be controlled as a function of the severing time.

The measuring element 16 also may be used for other purposes than only detecting the severing time. When during filling insertion the measuring element 16 of FIGS. 1 through 5 or 7 and 8 for instance does not detect, or detects only for a short time, a yarn tension, or if the measuring element 16 of FIG. 6 does not detect the presence of a filling, or detects the filling only for a short time, then the control unit 9 determines that a filling is lacking or is ruptured and will interrupt weaving. To determine the short time mentioned above, this time interval may be compared with one stored in the control unit 9.

Obviously the invention applies to a wider field than that of gripper weaving machines. It may also be advantageously used in other weaving machines, for instance gripper-shuttle weaving machines and similar ones wherein a filling shall be severed by a filling-scissors, preferably at the beginning of filling insertion.

The apparatus and method of the invention obviously are not limited to the illustrative embodiments shown in the Figures. Instead they can be implemented by other embodiments within the scope of the patent claims.

What is claimed is:

1. A method for monitoring insertion of filling yarns in a weaving machine, comprising the steps of:

inserting and binding a filling into a fabric;

severing the filling to be inserted from a previously inserted filling at a particular time; and detecting an exact time at which the filling is actually severed.

2. The method as claimed in claim 1, wherein in the step of severing the previously inserted filling the time at which the filling is severed is adjustable.

3. The method as claimed in claim 1, further comprising the step of displaying the time at which the filling is severed.

4. A method for monitoring insertion of filling yarns in a weaving machine, comprising the steps of:

inserting and binding a filling into a fabric;

severing the filling to be inserted from a previously inserted filling at a particular time;

detecting the time at which the filling is severed; and wherein in the step of detecting the time at which the filling is severed is determined by detecting tension in the filling.

5. An apparatus for monitoring the insertion of filling yarns in a weaving machine comprising:

a scissors arranged to sever a filling to be inserted from a previously inserted filling already bound into a fabric; and a detecting device arranged to detect an exact time at which the filling is actually severed.

6. The apparatus as claimed in claim 5, further comprising a time adjustment device that enables the adjustment of the time at which the scissors sever the filling.

7. The apparatus as claimed in claim 5, wherein the detecting device is connected to a display.

8. The apparatus as claimed in claim 5, wherein the detecting device is connectable to a group consisting of a control unit arranged to drive the scissors, a holding device arranged to hold in readiness the filling to be inserted, and yarn brakes.

9. An apparatus for monitoring the insertion of filling yarns in a weaving machine comprising:

a scissors arranged to sever a filling to be inserted from a previously inserted filling already bound into a fabric;

a detecting device arranged to detect the time at which the filling is severed; and a tension detecting device mounted in a vicinity of the scissors and arranged to detect tension of the filling that is placed in the scissors.

10. The apparatus as claimed in claim 9, wherein the tension detecting device further comprises a resilient measuring element.

11. The apparatus as claimed in claim 9, wherein the tension detecting device comprises a pressure pickup.

* * * * *